United States Patent [19]

Richman, Jr.

[11] Patent Number: 4,478,296

[45] Date of Patent: Oct. 23, 1984

[54] DRILL BIT HAVING MULTIPLE DRILL ROD IMPACT MEMBERS

[76] Inventor: Charles D. Richman, Jr., P.O. Box 229, Woodstown, N.J. 08098

[21] Appl. No.: 330,097

[22] Filed: Dec. 14, 1981

[51] Int. Cl.[3] ..... E21B 4/06; E21B 6/00

[52] U.S. Cl. ..... 175/92; 175/379; 175/381; 175/415; 299/62

[58] Field of Search ..... 175/92, 381, 336, 103, 175/321, 415, 379, 409, 410, 411; 299/62

[56] References Cited

U.S. PATENT DOCUMENTS

| | | | |
|---|---|---|---|
| 1,613,555 | 1/1927 | Boyd | 175/381 |
| 1,932,891 | 10/1933 | Harner | 175/381 |
| 2,198,849 | 4/1940 | Waxler | 175/336 |
| 2,883,155 | 4/1959 | Gehrke | 175/381 |
| 3,932,952 | 1/1976 | Helton et al. | 175/410 |
| 4,165,130 | 8/1979 | Mason | 299/62 |

FOREIGN PATENT DOCUMENTS

| | | | |
|---|---|---|---|
| 2610734 | 9/1977 | Fed. Rep. of Germany | 175/410 |

*Primary Examiner*—James A. Leppink
*Assistant Examiner*—Hoang C. Dang
*Attorney, Agent, or Firm*—Fitch, Even, Tabin & Flannery

[57] ABSTRACT

A drill bit for drilling a subterranean bore hole which includes a housing having a cap plate adapted for connection to a drill pipe and a base block axially aligned with and spaced from the cap plate by guide members. A plurality of elongated drill rod impact members are carried by a drill rod holder plate disposed between the cap plate and base block for movement longitudinally of the housing. The free ends of the drill rods extend through guide bores in the base block to define exposed working ends for chipping and crushing the formation upon rotation of the drill bit and the introduction of drilling fluid into the housing in a manner to effect a hammer-like action of the drill rods and progressively move them longitudinally outwardly from the base block as they undergo wear. Each drill rod is preferably of a cylindrical shape and is made harder at its center axis and progressively softer toward its outer periphery so that the working ends of the drill rods are continually maintained in a generally pointed condition during operation.

13 Claims, 5 Drawing Figures

DRILL BIT HAVING MULTIPLE DRILL ROD IMPACT MEMBERS

BACKGROUND OF THE INVENTION

The present invention relates generally to drill bits for use in drilling subterranean bore holes, and more particularly to a novel drill bit having a housing supporting a plurality of drill rod impact members operative to be progressively advanced as exposed working ends of the drill rods undergo wear during a drilling operation.

It is known in the drilling of bore holes, such as in drilling for oil or other fluids in subterranean chambers, to employ drilling tools, generally termed drill bits, which employ a plurality of percussion bits or cutter heads carried on a rotary framework and axially reciprocated so as to effect impacting of the bits against the subterranean formation in a manner to chip, crush and disintegrate the formation beneath the drill bit. See, for example, U.S. Pat. No. 2,371,248 to McNamara, U.S. Pat. No. 3,144,086, to Kurt et al., U.S. Pat. No. 3,387,673 to Thompson and U.S. Pat. No. 3,682,258 to Kelly et al. In the use of such drilling tools, which also may be termed gang drills, the cuttings are continually removed from the bottom of the bore hole by forcing a fluid, such as drilling mud, down into the bore hole through a drill pipe such that the drilling mud flows beneath the drill bit after which the drilling mud and cuttings are forced back up the bore hole about the drill pipe to the surface.

The gang type drills disclosed in the aforementioned United States patents share the common characteristic that each includes a plurality of down hole drills each of which carries a bit at its lower end on which is mounted a plurality of rock cutting teeth or percussion elements. When the cutting teeth or percussion elements on the various bits have undergone a predetermined degree of wear, the gang drill must be removed from the bore hole and the various bits reconditioned or replaced. The downtime required for such bit reconditioning or replacement plays a significant role in the economics of drilling subterranean bore holes. It thus follows that a gang type drill which extends the operating life of the gang drill while disposed within a bore hole would provide signficant economic advantages, both by reducing the overall time required to drill a bore hole of predetermined depth and in the saving of labor time required to remove the drill and recondition or replace the cutting bits.

BRIEF DESCRIPTION OF THE INVENTION

In accordance with the present invention, a gang type drill for use in drilling a subterranean bore hole is provided which includes a housing having a cap plate adapted for coupling to a drill pipe and a base block axially aligned with and spaced from the cap plate by guide rods or supports. A drill rod holder plate is disposed between the cap plate and base block in guided relation with the guide rods so as to be nonrotatably longitudinally movable relative to the housing. The holder plate carries a plurality of elongated drill rods which have their free ends extending through guide bores in the base block so as to define working end surfaces spaced outwardly from the base block for chipping and crushing the formation being bored upon rotation of the drill bit and the introduction of a drilling fluid into the housing in a manner to effect a longitudinal reciprocating or hammering movement of the drill rods. A plurality of rollers are rotatably carried by the base block so as to maintain the base block spaced from the floor of the bore hole to facilitate flow of drilling fluid for removal of cuttings. The individual drill rods are made of metallic material of progressively decreasing hardness from their axial centers toward their outer peripheral surfaces, thus contributing to self sharpening of the respective bits and minimizing wear of the base block bores. During a drilling operation, the drill bits are progressively fed longitudinally through the base block as their cutting ends undergo wear, thereby providing substantially longer continuous operating life for the drill.

Accordingly, a general object of the present invention is to provide a novel gang type drill bit for use in drilling a subterranean bore hole wherein the drill bit has improved operating life.

A more particular object of the present invention is to provide a novel gang type drill for use in drilling a subterranean bore hole which includes a rotable housing supporting a plurality of elongated drill bits disposed generally parallel to the rotational axis of the housing and adapted to be progressively longitudinally advanced as lower cutting ends thereon undergo wear so as to substantially prolong the operating life of the drill without need for removal from the bore hole.

A feature of the gang drill in accordance with the present invention lies in the provision of individual drill rod bits which define exposed operating ends for chipping and crushing the formation during rotation of the drill and axial reciprocating movement of the drill bits, and wherein each drill rod bit has progressively decreasing hardness from its center axis to its outer peripheral surface so as to maintain a generally self-sharpened impacting point thereon during a drilling operation.

Another feature of the gang drill in accordance with the present invention lies in the provision of a plurality of individual drill rods which are carried by a drill rod support plate in a manner to undergo a longitudinal reciprocating hammering movement by the action of a drilling fluid introduced into the drill bit housing, the drilling fluid also serving to progressively longitudinally advance the drill bits and effect continuous removal of cuttings from the bore hole during a drilling operation.

Further objects and advantages of the present invention, together with the organization and manner of operation thereof, will become apparent from the following detailed description of the invention when taken in conjunction with the accompanying drawings.

DESCRIPTION OF A PREFERRED EMBODIMENT

Figure 1:
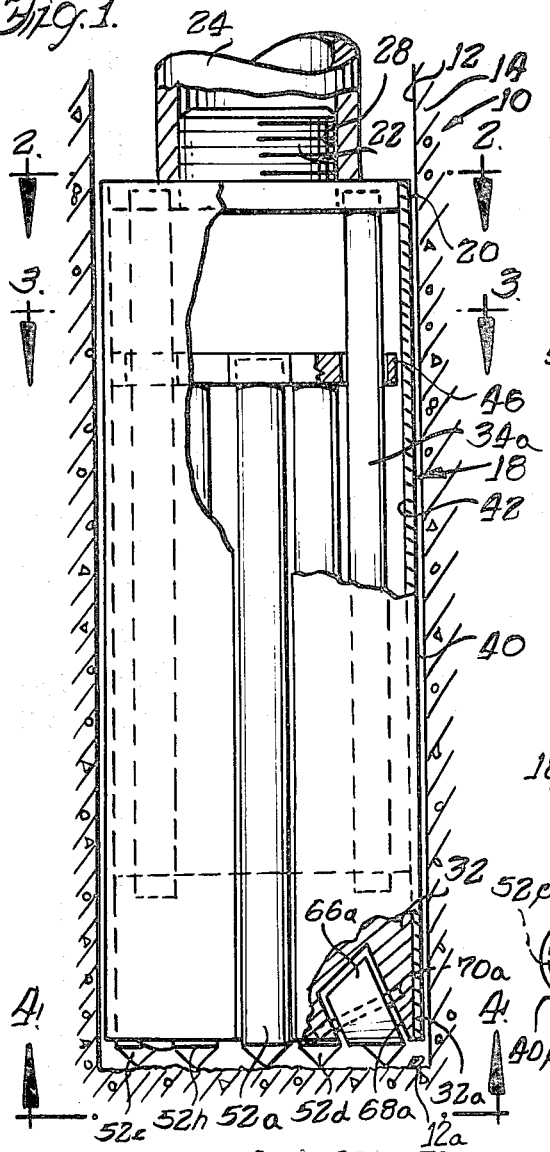
FIG. 1 is an elevational view of a drill bit constructed in accordance with the present invention, the bit having portions broken away for purposes of clarity and being shown connected to the lower end of a drill pipe and disposed within a bore hole.
Figure 2:
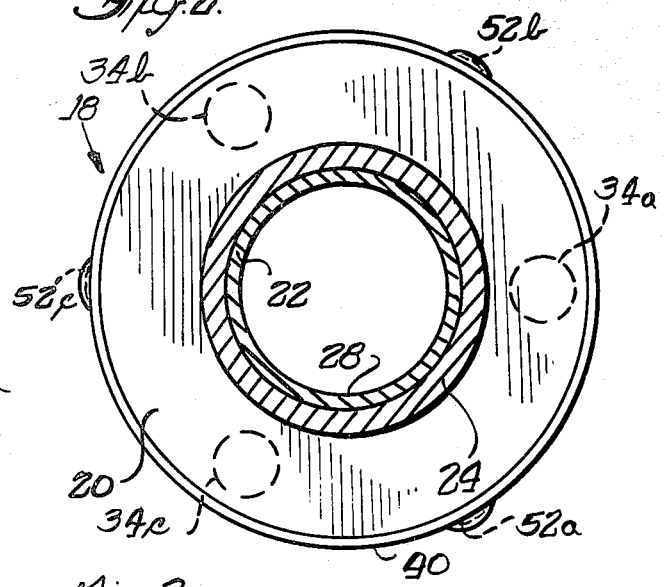
FIG. 2 is a transverse sectional view taken substantially along line 2—2 of FIG. 1, looking in the direction of the arrows, but rotated slightly about the longitudinal axis of the drill bit.
Figure 3:
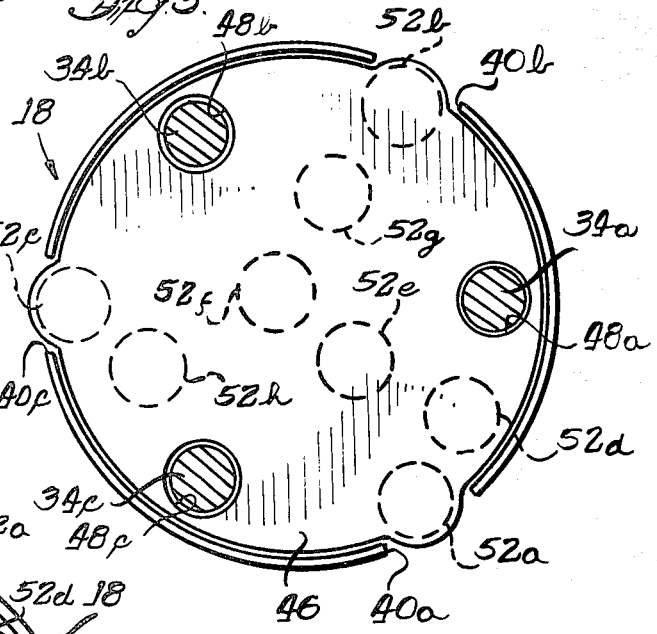
FIG. 3 is a transverse sectional line taken substantially along line 3—3 of FIG. 1, looking in the direction of the arrows, and also rotated slightly similar to FIG. 2.

Referring now to the drawings, a drill bit constructed in accordance with the present invention is indicated generally at 10. The drill bit 10, which may also be termed a gang drill, is adapted for use in drilling a substantially cylindrical subterranean bore hole 12 in the ground or terrain 14 for purposes of extracting a fluid such as water, oil or gas from a subterranean cavity or chamber. The drill bit 10 is particularly adapted for drilling a relatively deep bore hole, such as 10,000 feet or more, in a rock or similar hard formation.

The drill bit 10 includes housing means, indicated generally at 18 which, in the illustrated embodiment, is of generally cylindrical configuration and defines a longitudinal axis about which the drill bit is rotated during operation. The housing means 18 includes a generally planar circular cap plate 20 having a tubular coupling fitting 22 formed integral thereon or otherwise suitably secured to the upper surface of the cap plate centrally thereof. The coupling fitting 22 has an external standard pipe thread formed thereon to facilitate threaded connection of the drill bit 10 to an end of a tubular drill pipe 24 having a suitable internal thread adapted for threaded connection with the coupling fitting. The coupling fitting 22 has an internal cylindrical flow passage 28 therethrough which also extends through the cap plate 20 so that drilling fluid, such as drilling mud, may be introduced into the upper end of the drill pipe 24 and passed downwardly into the drill bit 10.

The housing means 18 also includes a base plate or block 32 having a cylindrical outer peripheral surface 32*a* of a diameter substantially equal to the outer diameter of the circular cap plate 20. The base block 32 is fixed to the cap plate 20 through a plurality of support or guide rods so as to be maintained in fixed axially aligned and longitudinally spaced relation with the cap plate. In the illustrated embodiment, three cylindrical guide rods 34*a,b* and *c* have their upper ends releasably secured to the cap plate 20, as by threaded engagement therewith, such that the axes of the guide rods are equidistantly circumferentially spaced about and lie on a common circle concentric with the longitudinal axis of the housing 18. While the guide rods 34*a–c* are illustrated as cylindrical rods, they may have different cross-sectional configurations such as generally rectangular or trapezoidal configurations.

The lower ends of the guide rods 34*a–c* are suitably affixed to the base block 32, such as by threaded engagement therewith, so as to maintain the base block in fixed longitudinally spaced relation from the cap plate 20.

An annular metallic casing 40 is connected at its upper and lower ends, respectively, to the outer peripheral surfaces of the cap plate 20 and base block 32 so as to define with the cap plate and base block a generally cylindrical internal chamber 42 within the housing means 18.

In accordance with one feature of the present invention, the drill bit 10 includes a plurality of individual drill rod impact members which, during operation of the drill bit 10, strike the bottom or floor surface 12*a* of the bore 12 with a hammer-like action to produce a chipping and crushing action on the formation being drilled. To this end, a generally planar drill rod holder plate 46 is disposed within the chamber 42 of housing means 18 and movable between the cap plate 20 and base block 32 while being cooperative with the guide rods 34*a–c* so as to be rotationally restrained during movement in the longitudinal direction of the housing means. The holder plate 46 has a generally circular outer peripheral surface of a diameter slightly less than the internal diameter of the casing 42 and has three cylindrical bores 48*a, b* and *c* positioned to receive the guide rods 34*a, b* and *c*, respectively, therethrough such that the guide rods restrain angular rotation of the holder plate 46 while enabling movement thereof longitudinally of housing means 18.

The drill rod holder plate 46 carries a plurality of elongated drill rod impact members which, in the illustrated embodiment, comprise eight substantially identically shaped drill rods 52*a–h*. Each of the drill rods 52*a–h*, which may alternatively be termed cutting heads, is affixed at its upper end to the drill rod holder plate 46 preferably through a threaded connection enabling replacement of the various drill rods after they have undergone predetermined wear, as will become more apparent hereinbelow.

Each of the elongated drill rods 52*a–h* extends through a corresponding bore hole 56*a–h*, respectively, formed in the base block 32. The bores 56*a–h* each have a diameter slightly greater than the diameter of the corresponding cylindrical drill rod so that the drill rods are maintained in parallel relation to the longitudinal axis of the housing means 18 and a radial spacing is established between the guide bores and the associated drill rods so as to enable passage of drilling fluid through the base block 32 peripherally of each of the drill rods.

Figure 5:
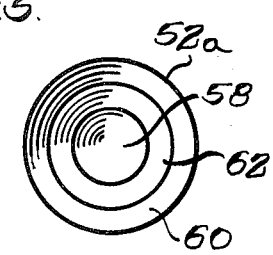
FIG. 5 is a bottom end view, on an enlarged scale, of a drill rod as employed in the drill bit of FIG. 1.

With reference to FIG. 5, each of the drill rods 52*a–h* has a substantially cylindrical outer peripheral surface and is made of one or more metallic materials processed so that the hardness of each drill rod is greatest at its center axis and decreases radially outwardly to its outer peripheral surface. To this end, each drill rod may be made of a composite metallic construction having a center core, such as indicated schematically at 58, of a predetermined hardness, such as 550 brinell hardness, a coaxial outer annular layer portion 60 of reduced hardness, such as a case hardened layer at 500 brinell hardness, and one or more annular intermediate layers, such as indicated at 62, of a material characterized as being tough but of a hardness intermediate the hardness of the core and outer peripheral layers 58 and 60, respectively. By so constructing the various drill rods 52*a–h*, the ends of the drill rods which engage the floor of the bore hole in a chipping and crushing action undergo a wear action such that the outer peripheral surface areas of the respective drill rods undergo greater wear than the axial cores 58 with the result that the working ends of the drill rods are maintained as generally pointed cutting heads having a continuous self-sharpening action.

As best illustrated in FIG. 1, the drill rods are made of sufficient initial length that with the drill rod holder plate 46 spaced slightly downwardly from the cap plate 20, the lower free ends of the drill rods extend through the respective bores 52*a–h* in the base block so as to establish exposed cutting ends on the drill rods. Preferably, the drill bit 10 includes roller means in the form of a plurality of frustoconical rollers mounted on the base block 32 so as to maintain the lower surface 32*b* of the base block spaced from the floor surface 12*a* of the bore 12 a sufficient distance to enable flow of drilling mud between the formation floor 12*a* and the base block. In the illustrated embodiment, three substantially identical frustoconical rollers 66*a, b* and *c* are mounted within suitably shaped recesses 68*a, b* and *c* in the base block 32 for rotation about respective support pins affixed to the base block, one of which is indicated at 70*a* in FIG. 1. The rollers 66*a, b* and *c* are equidistantly circumferentially spaced about the axis of the base block and extend below the base block so that the lowermost surfaces of the rollers lie in a plane parallel to the end surface 32*b* and spaced therefrom a predetermined distance.

In operation, the drill bit 10 is mounted on the lower end of a suitable drill pipe 24 and supported in a desired inclination, preferably vertically, to the ground or formation 14 in which a bore hole is to be drilled. A suitable drilling fluid of known composition, such as a known drilling mud, is introduced downwardly through the drill pipe 24. Simultaneously rotation of the drill pipe and associated drill bit is initiated by rotational drive means (not shown) of conventional design. The drill mud is introduced into the chamber 42 above the holder plate 46 in a controlled interrupted or pulsating pressure member so as to act with a hammer-like action on the holder plate 46, thereby imparting a hammer-like or repetitive force action acting longitudinally along the various drill rods 52*a–h* so as to effect a chipping or cyclic impacting of the lower cutting ends of the drill rods against the floor 12*a* of the bore hole 12.

As the drilling mud is introduced into the housing means 18, it flows downwardly through the annular spacing peripherally of each of the guide rods 34*a–c* so as to lubricate the guide rods, and also flows through an annular space about the outer surface of the holder plate 46 and thereafter downwardly through the base block along each of the drill rods during which the drilling mud lubricates and cools the drill rods. The drilling mud exiting from the base block 32 flushes along the lower surface of the base block and the cutting or impacting ends of the drill rods so as to cool the ends of the drill rods and also pick up cuttings and pass them upwardly between the outer surface of the casing 40 and the inner peripheral surface of the bore 12.

In accordance with the illustrated embodiment and to insure that an annular space is formed between the outer peripheral surface of the housing casing 40 and the inner generally cylindrical surface of the bore hole 12, three of the drill rods, such as indicated at 52*a,b* and *c*, are positioned peripherally about the axis of the drill bit so as to extend slightly radially outwardly from the outer peripheral surface of the casing 40 through corresponding rectangular openings 40*a,b* and *c* formed in the casing. In this manner, the cutting action of the drill rods 52*a, b* and *c* during operation of the drill bit serves to form the inner peripheral surface of the bore 12 of a diameter greater than the outer diameter of the casing 40. It is desirable to provide more than one drill rod to impact the formation floor 12*a* at the greatest radius from the axis of the bore hole since this portion of the floor of the bore hole has the greatest circumference and thus requires a greater number of chipping or crushing impacts in comparison to other areas of the bore hole floor for obtaining a predetermined depth of cut during each rotation of the drill bit 10. Also, by providing three equidistantly circumferentially spaced drill rods 52*a–c* about the axis of the drill bit 10, greater stability of the drill bit is maintained during a drilling operation.

Figure 4:
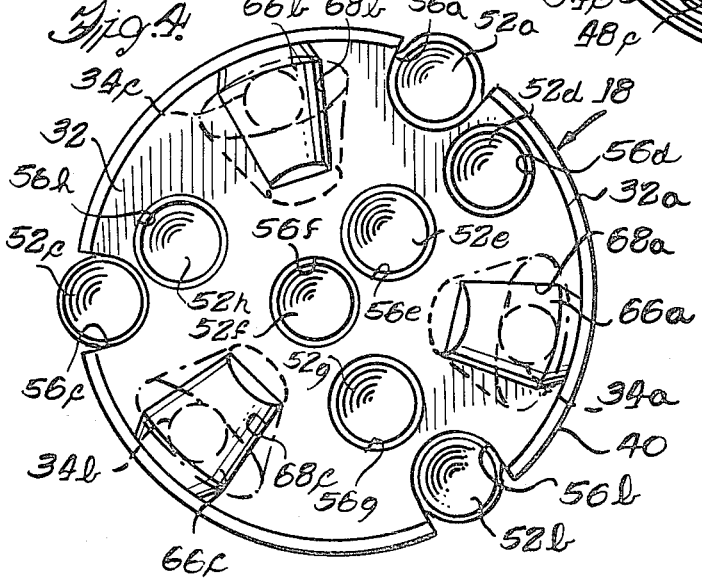
FIG. 4 is a bottom view taken substantially along line 4—4 of FIG. 1, looking in the direction of the arrows, and also rotated slightly similar to FIG. 2.

As best illustrated in FIG. 4, the remaining drill rods 52*d–h* are selectively spaced eccentrically to and about the rotational axis of the housing means 18 so that, upon rotation of the drill bit, substantially all of the area underlying the base block 32 is subjected to continuous impacting by the drill rods. The drill rods 52*d–h* extend through cylindrical bores 56*d–h*, respectively, formed in parallel relation through the base block 32.

As drilling of the bore hole 12 continues and the lower cutting or impacting ends of the drill rods 52*a–h* undergo wear, the drill rods 52*a–h* are progressively advanced downwardly relative to the base block 32 by the action of the drilling fluid against the upper surface of the holder plate 46 so as to form continually renewed exposed cutting or impacting ends on the drill rods. It will be appreciated that in the operation of the drill bit 10 of the present invention, the various drill rods 52*a–h* will continue to impact the floor surface of the bore hole until they are worn to an extent that the holder plate 46 engages the upper surface of the base block 32 and can no longer reciprocate or oscillate longitudinally of the housing means 18 under the influence of the pulsating pressure of the drilling mud introduced into the chamber 42. At this time, the drill bit 10 is removed from the bore hole and the various drill rods replaced.

Thus, in accordance with the present invention, a drill bit is provided which employs a plurality of drill rod impacting members adapted for continuous and progressive advancement during a drilling operation to continually expose cutting head ends for drilling purposes, thereby substantially prolonging the operating life of the drill bit between changing of the drill rods. Additionally, the various drill rods are of a construction that they undergo a self-sharpening action during a drilling operation.

While a preferred embodiment of the present invention has been illustrated and described, it will be understood that changes and modifications may be made therein without departing from the invention in its broader aspects. Various features of the invention are defined in the following claims.

What is claimed is:

1. A drill bit for use in drilling a subterranean bore hole in a formation comprising:

housing means defining a longitudinal axis and having a cap plate adapted to be coupled to a drill pipe so as to enable rotation of said housing means about its said longitudinal axis, said housing means including a base block, and means interconnecting said cap plate and said base block in fixed longitudinally spaced relation, a movable drill rod holder plate disposed between said cap plate and said base block in generally longitudinal alignment therewith and being movable longitudinally of said housing means, a plurality of elongated and advanceable drill rod impact members having first ends secured to said holder plate so as to be movable therewith, said drill rod impact members extending generally parallel to said longitudinal axis of said housing means and having cooperative relation with said base block so as to be maintained in said parallel relation during movement of said holder plate, said drill rod impact members having working ends extending outwardly from said base block so as to establish exposed chipping and crushing surfaces when subjected to longitudinal reciprocating movement during rotation of said housing means about its longitudinal axis, said drill rod impact members progressively longitudinally advancing for movement of said drill impact members for the exposure of additional chipping and crushing surfaces below said base block as said working ends under go wear.

2. A drill bit as defined in claim 1 wherein said base block has a plurality of openings therethrough each of which has an axis substantially parallel to said longitudinal axis of said housing means, each of said drill rod impact members extending through a respective one of said openings in said base block.

3. A drill bit as defined in claim 1 wherein said housing means includes a generally cylindrical casing extending between said cap plate and said base block and cooperating therewith to define a chamber within said housing means, said drill rod holder plate being disposed within said chamber and being movable therein between said cap plate and said base block.

4. A drill bit as defined in claim 3 wherein said cap plate is generally circular and has a coupling fitting centrally thereon, said coupling being adapted for connection to a drill pipe, said cap plate and coupling defining a flow passage therethrough enabling passage of a drilling fluid into said chamber.

5. A drill bit as defined in claim 3 wherein at least two of said drill rod impact members have their axes lying on a common diameter such that said at least two drill rod impact members extend radially outwardly from the outer peripheral surface of said casing so as to cut a bore diameter greater that the outer diameter of said annular casing.

6. A drill bit as defined in claim 1 wherein said means interconnecting said can plate and said base block includes guide rod means, said holder plate having cooperative assocation with said guide rod means so as to be maintained n substantially constant rotational relation to said base block during movement longitudinally of said housing means.

7. A drill bit as defined in claim 6 wherein said guide rod means comprises a plurality of guide rods disposed parallel to the longitudinal axis of said housing means, said holder plate lying in normal relation to the axes of said guide rods.

8. A drill bit as defined in claim 1 including a plurality of rollers rotatably mounted on said base block so as to maintain said base block spaced a predetermined distance from the floor surface end of the bore hole being drilled.

9. A drill bit as defined in claim 8 wherein said rollers have generally frustoconical outer peripheral surfaces and are mounted in said base block so as to define contact surfaces extending outwardly from a bottom face on said base block with the outermost portions of said outwardly extending surface portions lying in a common plane spaced from and generally parallel to said bottom face of said base plate.

10. A drill bit as defined in claim 1 wherein each of said drill rod impact members comprises a solid generally cylindrical drill rod made of a metallic material, each of said drill rods having progressively decreasing hardness measured from its center axis radially outwardly to its outer peripheral surface.

11. A drill bit as defined in claim 1 wherein said drill bit impact members are disposed in predetermined relation about said longitudinal axis of said housing means and are of sufficient number and size to collectively engage a substantially circular area upon rotation of said housing means during a drilling operation.

12. A drill bit for use in drilling a subterranean bore hole in a formation comprising:

housing means defining a longitudinal axis and having a cap plate adapted to be coupled to a drill pipe so as to enable rotation of said housing means about its said longitudinal axis, said housing means including a base block, and means interconnecting said cap plate and said base block in fixed longitudinally spaced relation, a movable drill rod holder plate disposed between said cap plate and said base block in generally longitudinal alignment therewith and being movable longitudinally of said housing means, a plurality of elongated and advanceable drill rod impact members having first ends secured to said holder plate so as to be movable therewith, said drill rod impact members extending generally parallel to said longitudinal axis of said housing means and having cooperative relation with said base block so as to be maintained in said parallel relation during movement of said holder plate, said drill rod impact members having working ends extending outwardly from said base block so as to establish exposed chipping and crushing surfaces when subjected to longitudinal reciprocating movement during rotation of said housing means about its longitudinal axis, said drill rod impact members being of sufficient length to enable progressive longitudinal advance of said impact members as said working ends under go wear, and said means interconnecting said cap plate and said base block includes guide rod means, said holder plate having cooperative association with said guide rod means so as to be maintained in substantially constant rotational relation to said base block during movement longitudinally of said housing means.

13. A drill bit as defined in claim 12 wherein said guide rod means comprises a plurality of guide rods disposed parallel to the longitudinal axis of said housing means, said holder plate lying in normal relation to the axes of said guide rods.

* * * * *

UNITED STATES PATENT AND TRADEMARK OFFICE

CERTIFICATE OF CORRECTION

PATENT NO. : 4,478,296

DATED : October 23, 1984

INVENTOR(S) : Charles D. Richman, Jr.

It is certified that error appears in the above-identified patent and that said Letters Patent is hereby corrected as shown below:

Column 5, line 26, "member" should read --manner--.

Column 7, line 33, "that" should read --than--.

Column 7, line 36, "can" should read --cap--.

Column 7, line 38, "assocation" should read --association--.

Column 7, line 39, "n" should read --in--.

Signed and Sealed this

*Twenty-third* Day of *July 1985*

[SEAL]

*Attest:*

DONALD J. QUIGG

*Attesting Officer*

*Acting Commissioner of Patents and Trademarks*